US009091056B2

(12) United States Patent
Stauffer et al.

(10) Patent No.: US 9,091,056 B2
(45) Date of Patent: Jul. 28, 2015

(54) MULTIPURPOSE CONCRETE ANCHOR CLIP

(71) Applicant: Simpson Strong-Tie Company, Inc., Pleasanton, CA (US)

(72) Inventors: Timothy M. Stauffer, Pleasant Hill, CA (US); Larry Randall Daudet, Brentwood, CA (US); Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 14/145,643

(22) Filed: Dec. 31, 2013

(65) Prior Publication Data

US 2015/0184371 A1 Jul. 2, 2015

(51) Int. Cl.

| | |
|---|---|
| ***E04B 1/38*** | (2006.01) |
| ***E04B 1/41*** | (2006.01) |
| ***E04C 5/06*** | (2006.01) |

(52) U.S. Cl.

CPC ..... *E04B 1/40* (2013.01); *E04C 5/0645* (2013.01); *E04B 2001/405* (2013.01)

(58) Field of Classification Search

USPC ..... 52/701, 702, 699, 92.2, 712, 317; 403/205, 231, 403; 248/220.1, 247, 248/248

See application file for complete search history.

(56) References Cited

U.S. PATENT DOCUMENTS

| | | | |
|---|---|---|---|
| 529,154 | A | 11/1894 | Banks |
| 719,191 | A | 1/1903 | Collins |
| 992,941 | A | 5/1911 | Danielson |
| 1,101,745 | A | 6/1914 | Jones |
| 1,346,426 | A | 7/1920 | Sherbner |
| 1,568,944 | A | 1/1926 | Beebe |
| 1,729,935 | A | 10/1929 | Froehlich |
| 1,791,197 | A | 2/1931 | Dickson |
| 1,945,925 | A | 2/1934 | Stiefel |
| 2,065,529 | A | 12/1936 | Kehr et al. |
| 2,218,426 | A | 10/1940 | Hurlbert, Jr. |
| 2,365,478 | A | 12/1944 | Grotta |
| 2,610,710 | A | 9/1952 | Shannon |
| 2,873,828 | A | 2/1959 | Zitomer |
| 2,900,677 | A | 8/1959 | Yetter |
| 2,905,426 | A | 9/1959 | Ross |
| 2,918,995 | A | 12/1959 | Kruger |
| 3,003,600 | A | 10/1961 | MacKenzie |
| 3,038,568 | A | 6/1962 | Morgan |
| 3,083,794 | A | 4/1963 | Stovail |

(Continued)

FOREIGN PATENT DOCUMENTS

| | | |
|---|---|---|
| WO | WO-96/31667 A1 | 10/1996 |

OTHER PUBLICATIONS

"Wall Bridging Detail". NuconSteel Product Catalog, 2003, front cover, table of contents, p. 34. NuconSteel., USA.

(Continued)

*Primary Examiner* — Brian Glessner
*Assistant Examiner* — Paola Agudelo
(74) *Attorney, Agent, or Firm* — James R. Cypher; Charles R. Cypher

(57) ABSTRACT

A connector with two flanges for making a variety of connections between structural members, in particular cold formed steel structural members, with the added utility of a accommodating a heavy bolted connection to one of the structural members with an extended tab on one flange that matches a recess on the other for optimal material consumption and minimal waste in manufacturing.

7 Claims, 9 Drawing Sheets

(56) References Cited

U.S. PATENT DOCUMENTS 3,126,928 A 3/1964 McMillan
3,299,839 A 1/1967 Nordbak
3,321,880 A 5/1967 Ferrell et al.
3,322,447 A 5/1967 Biggs
3,482,369 A 12/1969 Burke
3,490,604 A 1/1970 Klein
3,490,797 A 1/1970 Platte
3,537,219 A 11/1970 Navarre
3,606,227 A 9/1971 Klein
3,653,172 A 4/1972 Schwartz
3,715,850 A 2/1973 Chambers
3,778,952 A 12/1973 Soucy
3,798,865 A 3/1974 Curtis
3,805,465 A 4/1974 Dietrich
3,858,988 A 1/1975 Cohen
3,897,163 A 7/1975 Holmes
3,945,741 A 3/1976 Wendt
3,972,168 A 8/1976 Allen
3,972,169 A 8/1976 Sheppard, Jr.
4,018,020 A 4/1977 Sauer et al.
4,027,453 A 6/1977 Bridge
4,043,689 A 8/1977 Spencer
4,067,168 A 1/1978 Thurner
4,075,810 A 2/1978 Zakrzewski et al.
4,121,391 A 10/1978 Schroeder
4,128,979 A 12/1978 Price
4,140,294 A 2/1979 Zwarts
4,140,417 A 2/1979 Danielsen et al.
4,174,911 A 11/1979 Maccario et al.
4,208,851 A 6/1980 Sauer
4,235,054 A 11/1980 Cable et al.
4,246,736 A 1/1981 Kovar et al.
4,406,374 A 9/1983 Yedor
4,426,822 A 1/1984 Gailey
4,428,172 A 1/1984 Larsson
4,433,524 A 2/1984 Matson
4,448,004 A 5/1984 Thorsell
4,464,074 A 8/1984 Green et al.
4,480,941 A 11/1984 Gilb et al.
4,516,874 A 5/1985 Yang et al.
4,522,009 A 6/1985 Fingerson
4,560,301 A 12/1985 Gilb
4,570,400 A 2/1986 Slager et al.
4,586,841 A 5/1986 Hunter
4,625,415 A 12/1986 Diamontis
4,693,047 A 9/1987 Menchetti
4,791,766 A 12/1988 Egri, II
4,796,403 A 1/1989 Fulton et al.
4,809,476 A 3/1989 Satchell
4,819,401 A 4/1989 Whitney, Jr.
4,840,005 A 6/1989 Cochrane
4,843,776 A 7/1989 Guignard
4,850,169 A 7/1989 Burkstrand et al.
4,858,407 A 8/1989 Smolik
4,864,791 A 9/1989 Platt
4,912,894 A 4/1990 Platt
4,914,878 A 4/1990 Tamaki et al.
4,916,877 A 4/1990 Platt
4,949,929 A 8/1990 Kesselman et al.
4,951,436 A 8/1990 Burkstrand et al.
4,964,253 A 10/1990 Loeffler
5,027,494 A 7/1991 Martin
5,092,100 A 3/1992 Lambert et al.
5,104,252 A 4/1992 Colonias et al.
5,113,631 A 5/1992 diGirolamo
5,127,760 A 7/1992 Brady
5,155,962 A 10/1992 Burkstrand et al.
5,189,857 A 3/1993 Herren
5,216,858 A 6/1993 Gilmour
5,218,803 A 6/1993 Wright
5,253,465 A 10/1993 Gilb
5,265,396 A 11/1993 Amimoto
5,274,973 A 1/1994 Liang
5,274,981 A 1/1994 Commins
5,287,664 A 2/1994 Schiller
5,313,752 A 5/1994 Hatzinikolas
5,323,577 A 6/1994 Whitmyer
5,325,651 A 7/1994 Meyer et al.
5,335,469 A 8/1994 Stuart
5,363,622 A 11/1994 Sauer
2,365,501 A 12/1994 Walstrom
5,402,612 A 4/1995 diGirolamo
5,403,110 A 4/1995 Sammann
5,446,969 A 9/1995 Terenzoni
5,467,566 A 11/1995 Swartz et al.
5,471,805 A 12/1995 Becker
5,555,694 A 9/1996 Commins
5,572,844 A 11/1996 Stackenwalt et al.
5,577,860 A 11/1996 Plank
5,600,926 A 2/1997 Ehrlich
5,603,580 A 2/1997 Leek et al.
5,605,024 A 2/1997 Sucato et al.
5,625,995 A 5/1997 Martin
5,632,128 A 5/1997 Agar
5,640,823 A 6/1997 Bergeron et al.
5,642,597 A * 7/1997 Hendrickson ..... 52/715
5,664,392 A 9/1997 Mucha
5,669,198 A 9/1997 Ruff
5,671,580 A 9/1997 Chou
5,682,935 A 11/1997 Bustamante
5,689,922 A 11/1997 Daudet
5,697,725 A 12/1997 Ballash et al.
5,720,138 A 2/1998 Johnson
5,720,571 A 2/1998 Frobosilo et al.
5,755,066 A 5/1998 Becker
5,784,850 A 7/1998 Elderson
5,846,018 A 12/1998 Frobosilo
5,876,006 A 3/1999 Sharp
5,899,041 A 5/1999 Durin
5,904,023 A 5/1999 diGirolamo
5,906,080 A 5/1999 diGirolamo et al.
5,913,788 A 6/1999 Herren
5,921,411 A 7/1999 Merl
5,937,605 A 8/1999 Wendt
5,943,838 A 8/1999 Madsen
5,964,071 A 10/1999 Sato
5,983,589 A 11/1999 Daudet
6,021,618 A 2/2000 Elderson
6,058,668 A 5/2000 Herren
6,088,982 A 7/2000 Hiesberger
6,101,780 A 8/2000 Kreidt
6,112,495 A 9/2000 Gregg et al.
6,158,188 A 12/2000 Shahnazarian
6,164,028 A 12/2000 Hughes
6,199,336 B1 3/2001 Poliquin
6,199,929 B1 3/2001 Hansch
6,213,679 B1 * 4/2001 Frobosilo et al. ..... 403/403
6,242,698 B1 6/2001 Baker, III et al.
6,260,318 B1 7/2001 Herren
6,290,214 B1 9/2001 DeSouza
6,295,781 B1 10/2001 Thompson
6,301,854 B1 10/2001 Daudet et al.
6,315,137 B1 11/2001 Mulford
6,418,695 B1 7/2002 Daudet
6,430,890 B1 8/2002 Chiwhane et al.
D463,575 S 9/2002 Daudet
D467,007 S 12/2002 Daudet et al.
6,513,298 B2 2/2003 Rassel
6,523,321 B1 2/2003 Leek et al.
6,523,322 B1 2/2003 Michalski et al.
6,578,335 B2 6/2003 Poliquin
6,591,562 B2 7/2003 Ting
6,598,361 B2 7/2003 Ting
6,612,087 B2 9/2003 diGirolamo et al.
6,625,945 B2 9/2003 Commins
6,644,603 B2 11/2003 Bailleux
6,662,520 B1 12/2003 Nelson
6,668,510 B2 12/2003 McManus
6,688,069 B2 2/2004 Zadeh
6,691,482 B1 2/2004 Ault
6,694,695 B2 2/2004 Collins
6,701,689 B2 3/2004 diGirolamo
6,702,270 B1 3/2004 Reschke
6,708,460 B1 3/2004 Elderson

(56) References Cited

U.S. PATENT DOCUMENTS

| | | | | |
|---|---|---|---|---|
| 6,719,481 | B2 | 4/2004 | Hoffmann | |
| 6,739,562 | B2 * | 5/2004 | Rice | 248/247 |
| 6,748,705 | B2 | 6/2004 | Orszulak et al. | |
| 6,792,733 | B2 | 9/2004 | Wheeler | |
| 6,799,407 | B2 | 10/2004 | Saldana | |
| 6,843,035 | B1 | 1/2005 | Glynn | |
| 6,854,237 | B2 | 2/2005 | Surowiecki | |
| 6,871,470 | B1 | 3/2005 | Stover | |
| 6,920,734 | B2 | 7/2005 | Elderson | |
| 7,017,310 | B2 | 3/2006 | Brunt | |
| 7,021,021 | B2 | 4/2006 | Saldana | |
| 7,065,932 | B2 * | 6/2006 | Roesset et al. | 52/712 |
| 7,104,024 | B1 | 9/2006 | diGirolamo et al. | |
| RE39,462 | E | 1/2007 | Brady | |
| 7,159,369 | B2 | 1/2007 | Elderson | |
| 7,168,219 | B2 | 1/2007 | Elderson | |
| 7,174,690 | B2 | 2/2007 | Zadeh | |
| 7,225,590 | B1 | 6/2007 | diGirolamo et al. | |
| 7,293,393 | B2 | 11/2007 | Kelly et al. | |
| 7,299,593 | B1 | 11/2007 | diGirolamo et al. | |
| D558,039 | S | 12/2007 | Skinner | |
| 7,334,372 | B2 | 2/2008 | Evans et al. | |
| 7,367,168 | B2 | 5/2008 | Lin | |
| D573,873 | S | 7/2008 | Wall | |
| 7,398,621 | B2 * | 7/2008 | Banta | 52/93.1 |
| 7,451,573 | B2 | 11/2008 | Orszulak et al. | |
| 7,478,508 | B2 | 1/2009 | Peterson | |
| 7,503,148 | B2 | 3/2009 | Lin | |
| 7,503,150 | B1 | 3/2009 | diGirolamo | |
| 7,520,100 | B1 | 4/2009 | Herrman | |
| 7,533,508 | B1 | 5/2009 | diGirolamo et al. | |
| 7,559,519 | B1 | 7/2009 | Dragic | |
| 7,596,921 | B1 | 10/2009 | diGirolamo | |
| 7,617,643 | B2 | 11/2009 | Pilz et al. | |
| 7,634,889 | B1 | 12/2009 | diGirolamo et al. | |
| 7,640,701 | B2 | 1/2010 | Rutherford | |
| 7,644,549 | B2 | 1/2010 | Speck | |
| 7,658,356 | B1 | 2/2010 | Nehls | |
| 7,681,365 | B2 | 3/2010 | Klein | |
| 7,707,785 | B2 | 5/2010 | Lin | |
| 7,716,899 | B2 | 5/2010 | Beck et al. | |
| 7,735,295 | B2 | 6/2010 | Surowiecki | |
| 7,739,850 | B2 | 6/2010 | Daudet | |
| 7,752,817 | B2 | 7/2010 | Pilz et al. | |
| 7,788,878 | B1 | 9/2010 | diGirolamo et al. | |
| 7,836,657 | B1 | 11/2010 | diGirolamo | |
| 7,856,763 | B2 | 12/2010 | Keys et al. | |
| 7,913,472 | B2 | 3/2011 | Troth et al. | |
| 7,955,027 | B2 | 6/2011 | Nourian et al. | |
| 7,971,409 | B2 | 7/2011 | Bak et al. | |
| 7,971,411 | B2 | 7/2011 | Commins | |
| 7,987,636 | B2 | 8/2011 | Hunt | |
| D644,503 | S | 9/2011 | Crane et al. | |
| 8,011,160 | B2 * | 9/2011 | Rice | 52/745.09 |
| D648,249 | S | 11/2011 | Noble et al. | |
| 8,083,187 | B2 | 12/2011 | Bernard et al. | |
| 8,091,316 | B2 | 1/2012 | Beck et al. | |
| D657,891 | S | 4/2012 | Jones | |
| 8,167,250 | B2 | 5/2012 | White | |
| 8,181,419 | B1 | 5/2012 | digirolamo | |
| 8,205,402 | B1 | 6/2012 | digirolamo | |
| 8,225,581 | B2 | 7/2012 | Strickland et al. | |
| D667,249 | S | 9/2012 | London | |
| D667,718 | S | 9/2012 | Preda | |
| 8,387,321 | B2 | 3/2013 | digirolamo et al. | |
| 8,528,292 | B2 | 9/2013 | Morey | |
| D692,746 | S | 11/2013 | Lawson et al. | |
| 2001/0045075 | A1 * | 11/2001 | Watanabe | 52/712 |
| 2002/0059773 | A1 | 5/2002 | Elderson | |
| 2003/0009980 | A1 | 1/2003 | Shahnazarian | |
| 2003/0037494 | A1 | 2/2003 | Collins | |
| 2003/0089053 | A1 | 5/2003 | Elderson | |
| 2003/0145537 | A1 | 8/2003 | Bailey | |
| 2003/0167722 | A1 | 9/2003 | Klein et al. | |
| 2005/0086905 | A1 | 4/2005 | Ralph et al. | |
| 2006/0096192 | A1 | 5/2006 | Daudet | |
| 2007/0044421 | A1 * | 3/2007 | Nguyen | 52/698 |
| 2007/0234662 | A1 | 10/2007 | Hanig et al. | |
| 2007/0251186 | A1 | 11/2007 | Rice | |
| 2010/0011697 | A1 | 1/2010 | Nguyen et al. | |
| 2010/0031601 | A1 | 2/2010 | Lin | |
| 2010/0126103 | A1 | 5/2010 | digirolamo et al. | |
| 2011/0107710 | A1 | 5/2011 | Sias | |
| 2011/0154770 | A1 | 6/2011 | Friis | |
| 2012/0079786 | A1 * | 4/2012 | O'Donnell | 52/698 |
| 2013/0104490 | A1 | 5/2013 | Daudet et al. | |
| 2014/0047792 | A1 | 2/2014 | Daudet et al. | |
| 2014/0270916 | A1 | 9/2014 | Daudet et al. | |
| 2014/0270923 | A1 | 9/2014 | Daudet et al. | |
| 2015/0033662 | A1 | 2/2015 | Daudet et al. | |

OTHER PUBLICATIONS

"Double Deep-Leg Track", "Bridge Clip Installation", "BC600 & BC800 Installation", "BridgeBar", "BridgeClip", "BC600 or BC800". The Steel Network, Inc. Product Catalog, Jan. 2004, front cover, p. 11, 27, 49. Steel Network, Inc., USA.

"Bridging, Bracing & Backing: Spazzer 5400 Spacer Bar (SPZS), Bar Guard (SPBG) & Grommet (SPGR)". Clip Express Product Catalog: Clips, Connectors & Framing Hardware, Apr. 2012, p. 77. Clark Dietrich Building Systems, USA.

"Metal-Lite Products". Metal Lite website, metal-lite.net. Accessed Sep. 20, 2013, one page. Metal Lite 2012, USA.

"Mantisgrip Product Catalog 2012". Catalog, 2012, 10 pages and cover. Mantisgrip 2012, USA.

U.S. Appl. No. 13/845,057, "Inverted Bridging Connector". Unpublished (filed Mar. 7, 2013), (Daudet, Larry R. and Oellerich, Paul H., Applicants), application p. 1-38; drawings p. 1-10.

"Multiple Truss Hangers; Twist Straps; Girder Tiedowns". Simpson Strong-Tie Product Catalog: Plated Truss Connectors and Masonry Connectors, C-2011, p. 141 and 163, USA.

"HD/HDN Holdowns", Simpson Strong-Tie Product Catalog: Strong-Tie Connectors. 1986, p. 6, USA.

"Hold Downs: KHDA/KHD/KHDN", Lumberlok: Engineered Metal Fasteners Product Catalog. MiTek Group Company, 1988, p. 6 and back cover, USA.

"Wood to Wood Uplift Connector Assembly; Masonry Uplift Connectors", Hughs Manufacturing, Inc. Product Catalog, 1997/1998. pp. 24, 37 and front cover. Largo, FL.

"Angles and Hold Downs", KC Metals Superspeed Connectors Product Catalog, 1980. p. 26, USA.

"StiffClip CL Floor Tie", Steel Network Product Catalog, Aug. 2011. p. 49, USA.

"Wood Construction Connectors", Simpson Strong-Tie Company Catalog, C-2009, pp. front cover, 25, 40128,136,152,158, 162-164, 166-167, 171, 179, 180, back cover. 2009-2010, Simpson Strong-Tie Company, Inc., USA.

"Handverkerkatalog", BMF Catalog, 1989, pp. front cover, 1.10.2, 1.15.2, 1.20.2, 1.25.2, 1.30.2, 1.35.2, 1.40.2, 1.45.2,1.50-51.2, 1.55.2, 1.65.2, 3.20.2, 5.10.2, 6.10.2, 7.25.2, 9.00.2, 13.00. Printed in the Netherlands.

"Re-Defining the Standard" USP Lumber Connectors, A Gibraltar Company, Full Line Catalog 2000. pp. front cover, 14, 18, 27, 7275, 78, 81, 101, 149. United Steel Products Company, 2000, Montgomery, MN.

"Wood to Wood: Heavy Angles" Hughes Manufacturing, Inc. Product Catalog, 1997-1998. pp. front cover and p. 25. Hughes Manufacturing, Inc., 1998, Largo, Florida, USA.

"Advanced Connector Systems: Connectors for Wood Construction" Product Catalog 1997, pp. front cover, 29, 30 , 33. Advanced Connector Systems, USA.

"Metal Connectors" SEMCO Product Catalog 1997-1998, pp. cover, 16, 21, 24, 34, 35, 53, 59, back cover. Southeastern Metals Manufacturing Company, Inc., 1998, Jacksonville, FL.

"Superspeed Connectors: Structural Wood Fasteners", Golden Gate Equipment Product Catalog, Jan. 1974. pp. cover page, 9, 12, 23. KC Metal Products, Jan. 1974, USA.

(56) References Cited

OTHER PUBLICATIONS

"Structural Wood Fasteners", TECO Product Catalog, Jun. 1972. pp. cover, 5, 7, 11, back cover. TECO Publication No. 101, Washington D.C., 1972, USA.
"Structural Timber Connectors", HMP Product Catalog No. 390. pp. cover, 4, 7, 8, 15, 18, 20, 24-26, back cover. Harlen Metal Products, Inc., 1990, Compton, CA, USA.
"Connectors", KANT-SAG Product Catalog No. 100-7/84. pp. cover, 12, 30, 32, 38, 40-42, 50. United Steel Products Company, 1984, Minnesota, USA.
"Silver Catalog S81 Sweet's 1981 Architectural File", Silver Metal Products Catalog, 1981. pp. cover, 19-22, 25. Silver Metal Products, Inc., 1981, USA.
"Framing Accessories: Building and Concrete Construction Devices" Bowman Product Catalog 1978-1979. pp. cover, 3, 5, 6, 20. P.H. Bowman Co., Inc., Jun. 1978, USA.
"Engineered Metal Fasteners" Lumberlok Product Catalog, 1988. pp. cover, 32-33, 38-39, 47. A MiTek Group Company, LumberLok, May 1988, USA.
"Superspeed Connectors: Structural Wood Fasteners" KC Metals Product Catalog, 1978. pp. front cover, 5, 36, 41, back cover. KC Metals Products, Inc., 1978, San Jose, CA, USA.
"Superspeed Connectors: Connectors for Wood Construction", KC Metals Product Catalog, 1992. pp. front cover, 16, 19, 24, 34, 36, 38, back cover. KC Metals Products, Inc., 1992, San Jose, CA, USA.
Tanaka Steel Product Catalog, pp. front cover, 40, 72. Tanaka Steel, Inc., Jul. 1996, Japan.
"Curtain Wall Systems; DriftClip and DriftTrak", The Steel Network Product Catalog, May 2009. pp. front cover, 32 and 36. The Steel Network Inc., Durham, NC, USA, 2009.
"Deflection Clips: Bypass Slab Slide Clip PLC2", Priceless Steel Products Catalog, 2004. pp. 12 and 13. Scafco Steel Stud Manufacturing, Co., www.pricelesssteel.com, USA.
"Clip Central", Priceless Steel Products Clip Central website, http://www.pricelesssteel.com, printed on Aug. 30, 2010, 2 pgs.
"VertiClip SLB", Steel Network Products website, http://www.steelnetwork.com/Product/VertiClipSLB, printed on Dec. 26, 2012, 2 pgs.
"Curtainwall Deflection Solutions", Super Stud Building Products Catalog, 2001. pp. front cover, inside cover, 8-13, 16-17, specifications page, company overview page, back cover. Super Stud Building Products, Inc., 2000, NY, USA.
"Light Steel Framing Connections: Interior, Exterior, Vertical Deflection, Drift", The Steel Network Product Catalog, Nov. 2013. pp. front cover, 6,9,11,13,15-21,27-32,35-37,42,47,50-53, 55,65,69,75,76. The Steel Network, Inc., 2013, USA.
"CD-Clip Express" Clark Dietrich Product Catalog, Apr. 2012. pp. front cover, 15-19,22-23,30-49,94, back cover. Clark Dietrich Building Systems, 2012, OH, USA.
"CD-Clip Express: Rigid Connections: Moment Clip (MC Series)", Clark Dietrich Product Catalog, Nov. 2014. pp. 1 and 2, Clark Dietrich Building Systems, 2014, OH, USA.
"FA—Secure Floor Anchor Clip", Scafco Product Catalog, Apr. 2013. p. 23. Steel Stud Company, Inc., 2013, USA.
"FrameRite Connectors: Rigid Clip Connector (RCC)", Marino|Ware Product Catalog, Jul. 2008. 2 pages. Marino Ware and www.marinoware.com, USA.
Schafer, B.W., et al., "Accommodating Building Deflections: What every EOR should know about accommodating deflections in secondary cold-formed steel systems." NCSEA/CASE/SEI, Structure Magazine, Apr. 2003, Chicago.
"International Search Report and the Written Opinion of the International Searching Authority," PCT/US2012/030963, Jul. 30, 2012, 6 pages.
"Redi Klip Submittal: Head-of-Wall Positive Attachment Deflection Clip," Total Steel Solution, as early as May 22, 2013, 2 pages, USA.
"Posi Klip Product Information: Head-of-Wall Positive Attachment Deflection Clip," FireTrak Corporation, as early as May 22, 2013, 1 page, USA.
"Sliptrack Systems: Slotted Deflections Track Systems for Interior and Exterior Walls," SlipTrack Systems, 2003, 6 pages. Dietrich Metal Framing: A Worthington Industries Company, USA.
"TSN Products: Steel framing products," The Steel Network TSN website, 2010, 2 pages. The Steel Network, Inc., USA.
"TSN Product: VertiClip® SLB," The Steel Network TSN website, Dec. 26, 2012, 2 pages, The Steel Network, Inc., USA.
"Priceless Steel Products Clip Central," Priceless Steel Products Website, Aug. 30, 2010, 2 pages. Scafco Steel Stud Manufacturing Co., WA.
"Bypass Slab Slip Clip: PLC2," Priceless Steel Product Catalog, as early as May 22, 2013, p. 12-13. Scafco Steel Stud Manufacturing Co., WA.
"SLP-TRK® Slotted Track (BDTK)," "Head of Wall," SlipTrack Systems, as early as Jul. 2010, p. 26-29. Dietrich Metal Framing: A Worthington Industries Company, USA.
"Curtainwall Deflection Solutions," Buy Super Stud Website, Aug. 2010, 2 pages. Super Stud Building Products, Inc., Edison.
"Curtain Wall Systems", "Jam Stud Introduction", "Design Considerations", "Header/Sill Solutions", "Connections", "VertiClip: Vertical Deflection Connectors", "DriftClip and DriftTrk: Vertical Deflection and Lateral Drift", "Bridging", "Design Software," TSN the Steel Network Product Catalog, May 2009, cover page, p. 1, 4,18, 30-33, 35, 36, back cover. The Steel Network, Inc., USA.

* cited by examiner

MULTIPURPOSE CONCRETE ANCHOR CLIP

BACKGROUND OF THE INVENTION

The present invention relates to cold formed steel framing systems, and particularly to anchoring steel studs with anchor bolts embedded in masonry, including poured concrete as well as masonry units.

Many industrial, and a growing number of residential, buildings are constructed with steel stud wall framing for a variety of reasons. Steel framing is fireproof, does not warp, cannot be infested, and does not rot. The majority of connections between structural members are made a right angles, including the connections between vertical framing members, such as wall studs, and the underlying floors and foundations.

Light steel framing is ideal for floors, roofs, support structures for finishes, non-load bearing walls, and even load-bearing walls up to approximately nine stories. With wall systems, whether they are load-bearing or non load-bearing, it is customary to use connectors or clips to secure individual metal studs to overlying and/or underlying support structures. Various connector or clip designs are known. For example, it is known to use simple L-shaped connector designs to interconnect metal studs with an underlying or overlying floor structure, for example. However, typical L-shaped connectors may not necessarily handle the variety of loads and forces that are sometimes experienced where studs are joined or secured to a floor or other support structure. More particularly, conventional connector designs may not always efficiently and effectively resist uplift, horizontal and rotational loads that are experienced about connecting points between such studs and an adjacent support structure.

Therefore, there has been and continues to be a need for a more heavy duty and durable connector for connecting metal studs to floors and other adjacent support structures that will effectively resist uplift, horizontal and rotational loads.

SUMMARY OF THE INVENTION

The present invention provides a connector with two flanges for making a variety of connections between structural members, in particular cold formed steel structural members, with the added utility of a accommodating a heavy bolted connection to one of the structural members with an extended tab on one flange that matches a recess on the other for optimal material consumption and minimal waste in manufacturing.

The present invention provides a multipurpose connector with a tab extension on one flange that has an outer contour that is exactly equal to the contour of a concave recess on the other flange so that there is no material loss when the connectors are formed from a long coil or strip of material on progressive die stamping machinery.

The present invention provides a connector suitable for making a large number of connections with a tab on one flange that accommodates a bolt hole with the minimum of material surrounding the bolt hole.

The present invention provides a connector with flanges of unequal length in order to make the largest possible number of connections while conserving material.

The present invention provides a connector that can, in addition to forming a number of connections between metal structural members, act as a holdown, anchoring a structural member to an underlying masonry (including poured concrete and masonry units) floor or foundation in cooperation with a bolt embedded in the masonry, either before or after the connector is positioned.

DETAILED DESCRIPTION OF THE INVENTION

Figure 8:
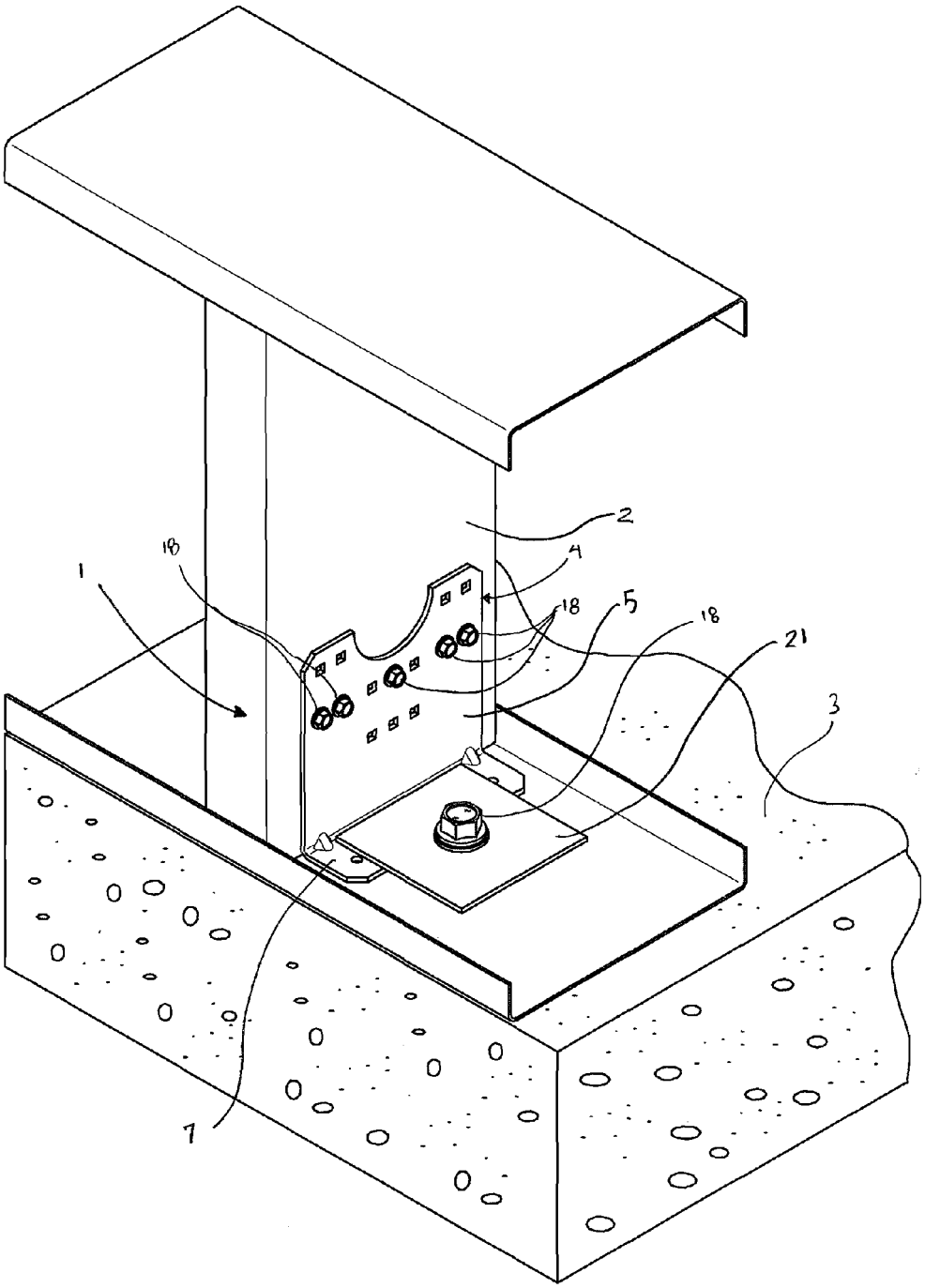
FIG. 8 is an upper left front perspective view of a stud-to-foundation anchor connection formed with the multipurpose connector of the present invention.
Figure 9:
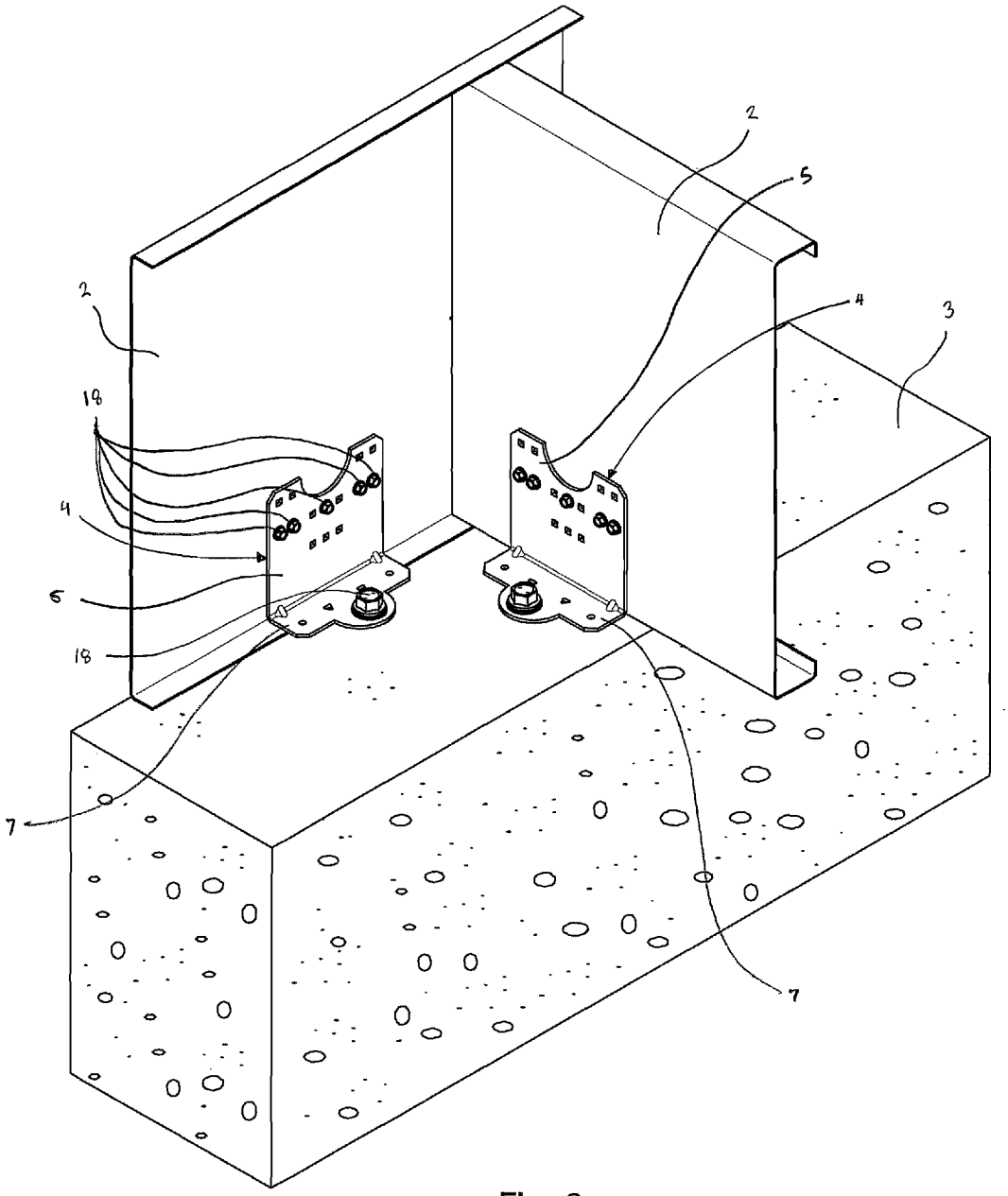
FIG. 9 is an upper front perspective view of two anchor connections formed with the multipurpose connectors of the present invention.
Figure 10:
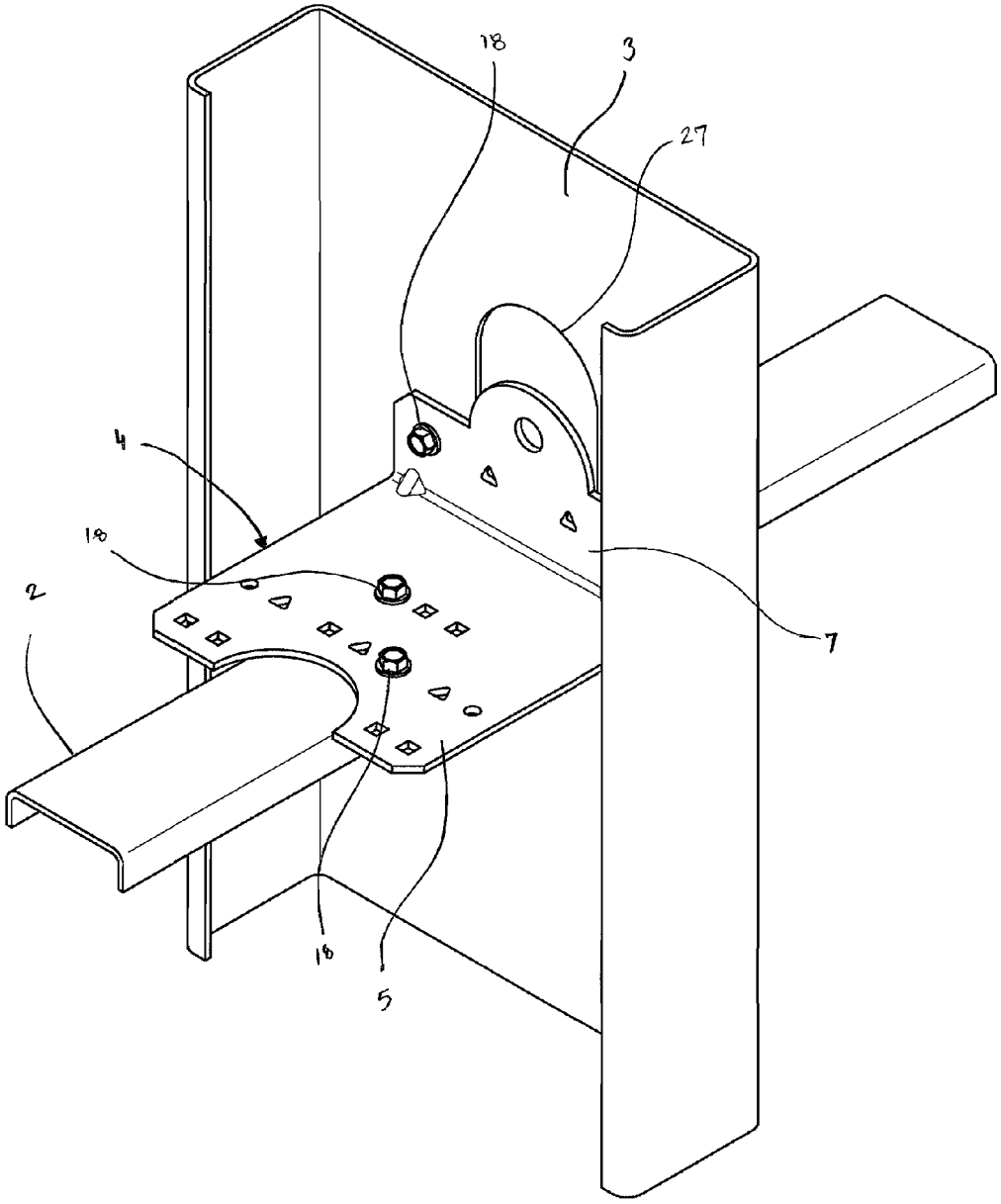
FIG. 10 is an upper right front perspective view of a bridging member-to-stud connection formed with the multipurpose connector of the present invention.

As best seen in FIGS. 8-10, the present invention is a building connection 1 between a first structural member 2 and a second structural member 3. The first structural member 2 and the second structural member 3 are connected by a multipurpose connector 4 in conjunction with a plurality of fasteners 18.

Preferably, the building connection comprises the first structural member 2, the second structural member 3, the plurality of fasteners 18, and the multipurpose connector 4.

Figure 1:
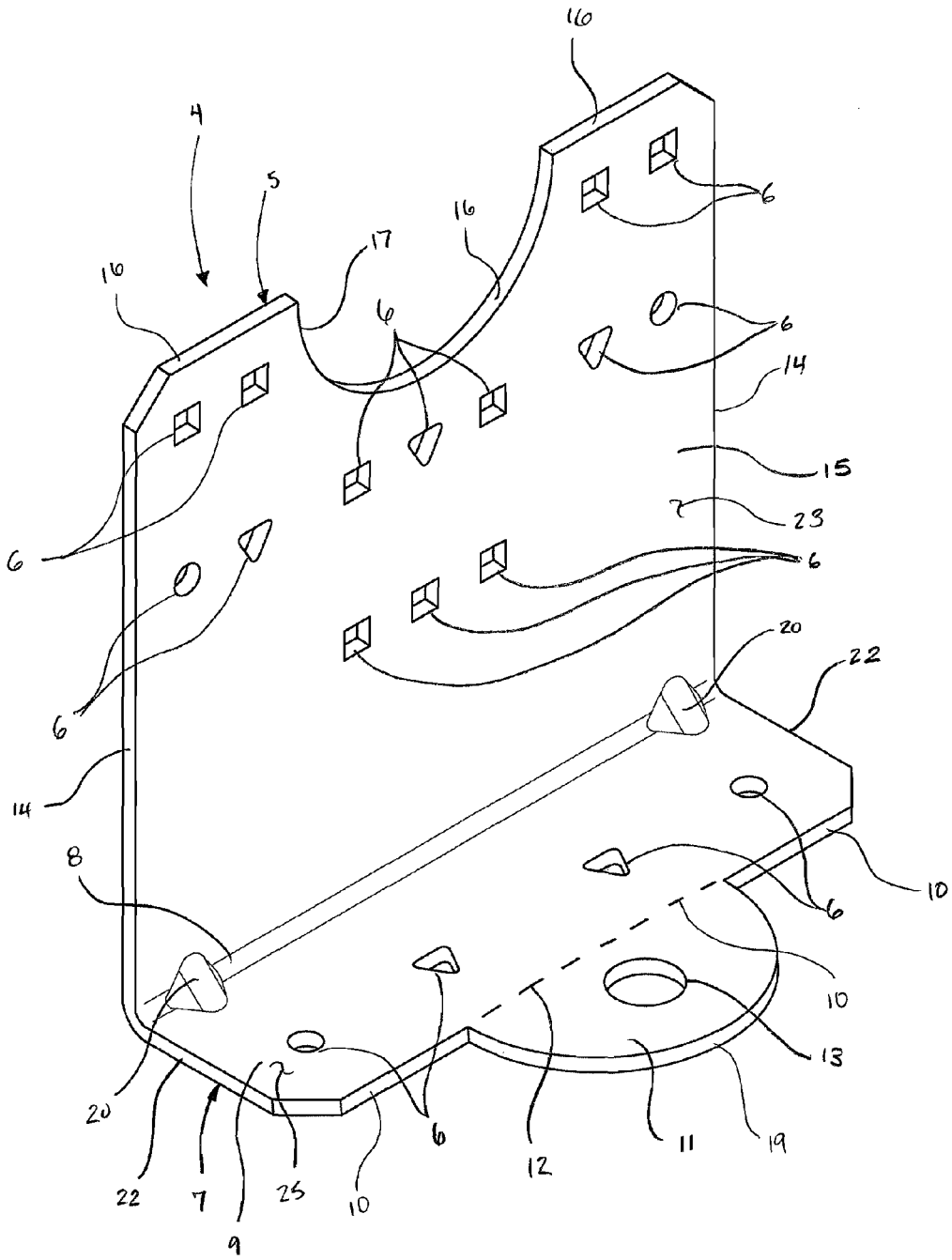
FIG. 1 is an upper left front perspective view of the multipurpose connector of the present invention.
Figure 2:
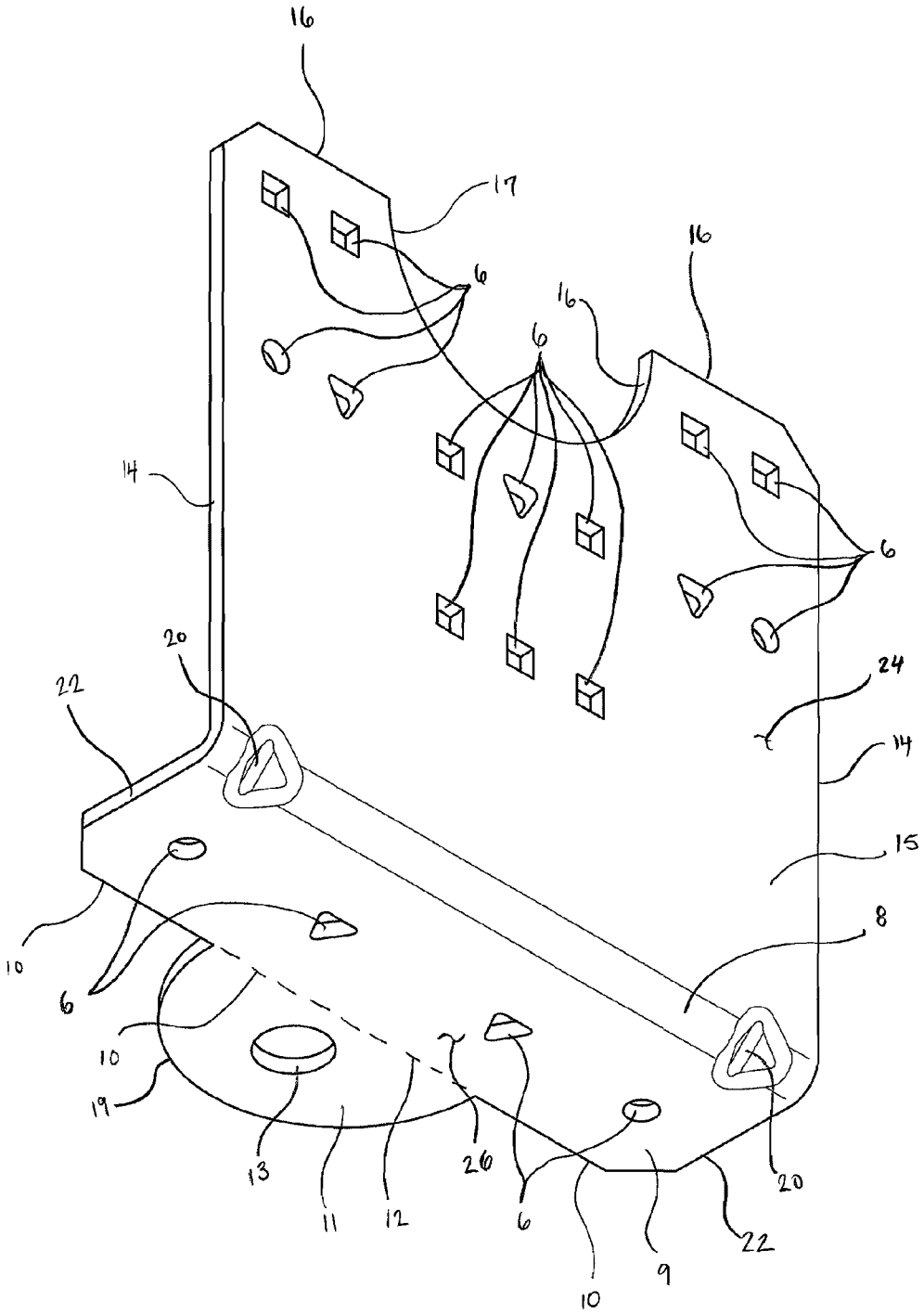
FIG. 2 is a lower right rear perspective view of the multipurpose connector of the present invention.

As best seen in FIGS. 1 and 2, the multipurpose connector 4 preferably comprises a first flange 5 and a second flange 7. Preferably, at least a portion of the first flange 5 is substantially planar, with a first plurality of fastener openings 6. Preferably, at least a portion of the second flange 7 is substantially planar, with a second plurality of fastener openings 6. The second flange 7 preferably is angularly joined to the first flange 5 at a first angular juncture 8 that a first juncture length 80. The multipurpose connector 4 is preferably formed from sheet steel by progressive die stamping, in which case the first angular juncture 8 is a bend line. The first and second flanges 5 and 7 preferably are completely planar except for a pair of small gussets 20 embossed in the first angular juncture 8 to reinforce it.

Figure 5:
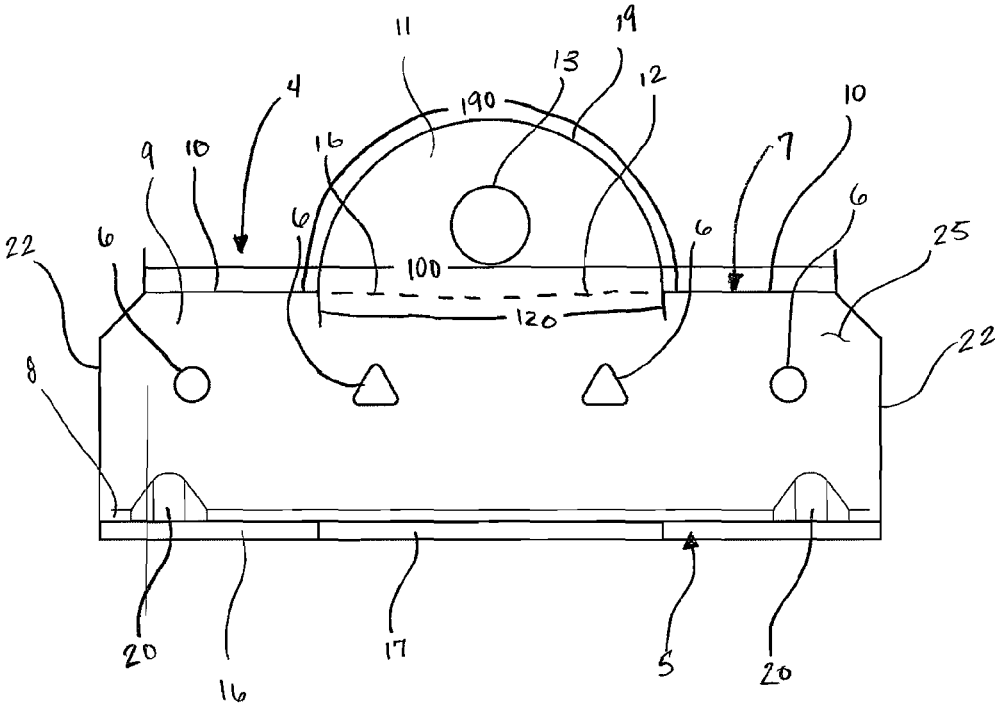
FIG. 5 is a top plan view of the multipurpose connector of the present invention.
Figure 6:
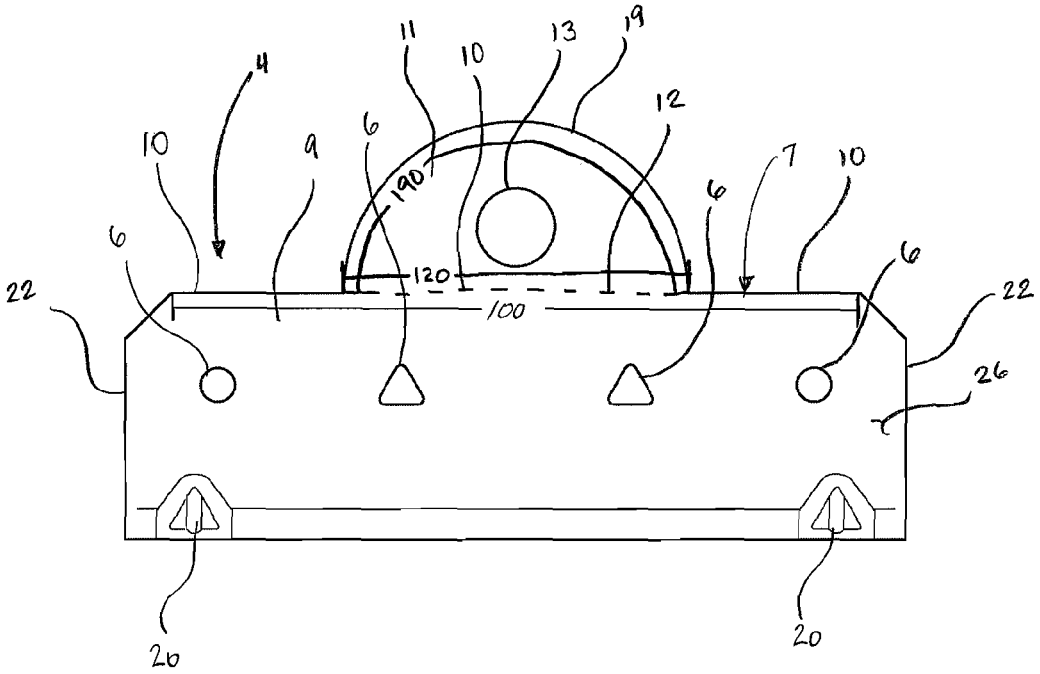
FIG. 6 is a bottom plan view of the multipurpose connector of the present invention.

Preferably, the second flange 7 has a second body portion 9 bounded at least in part by a second outer boundary 10 at least partially opposite the first angular juncture 8. As seen in FIGS. 5 and 6, the second outer boundary 10 preferably has a second outer boundary length 100. In the preferred embodiments, the second outer boundary 10 is straight and parallel to the first angular juncture 8. Preferably, the second flange 7 has a first tab 11 that extends from the second outer boundary 10 away from the angular juncture 8. The first tab 11 preferably joins the second body portion 9 of the second flange 7 at an inner tab boundary 12 that is partially coincident with the second outer boundary 10. As seen in FIGS. 5 and 6, preferably the inner tab boundary 12 has a inner tab boundary length 120 that is less than the second outer boundary length 100, such that the second body portion 9 is wider than the first tab 11 and extends to either side of the first tab 11. The second flange 7 preferably has a first bolt opening 13 that is at least partially within the first tab 11 and is larger than at least one of the second plurality of fastener openings 6. In the preferred embodiments, the first bolt opening 13 is large enough to accommodate a ⅜-inch diameter drill bit, while the other fastener openings 6 accommodate #14 (nominal 0.242-inch diameter) self-drilling screws for cold-formed steel framing. The second flange 7 preferably also has first and second sides 22 that connect the second outer boundary 10 of the second flange 7 to the first angular juncture 8. The second flange 7 preferably has a second inner surface 25 and a second outer surface 26. The second outer surface 26 interfaces with the second structural member 3.

In the most preferred embodiment, the first and second sides 22 of the second flange 7 are 4.25 inches apart, substantially straight, and substantially parallel to each other. The fastener openings 6 in the second body portion 9 are centered 0.75 inches from the first angular juncture 8. The two outermost (closest to the first and second sides 22) of those fastener openings 6 are centered 0.5 inches from the first and second sides 22, respectively, of the second flange 7. The two innermost (furthest from the first and second sides 22) of those fastener openings are centered 1.5 inches from the first and second sides 22, respectively, of the second flange 7. The first tab 11 extends a maximum of 2.1875 inches from the first angular juncture 8.

Figure 3:
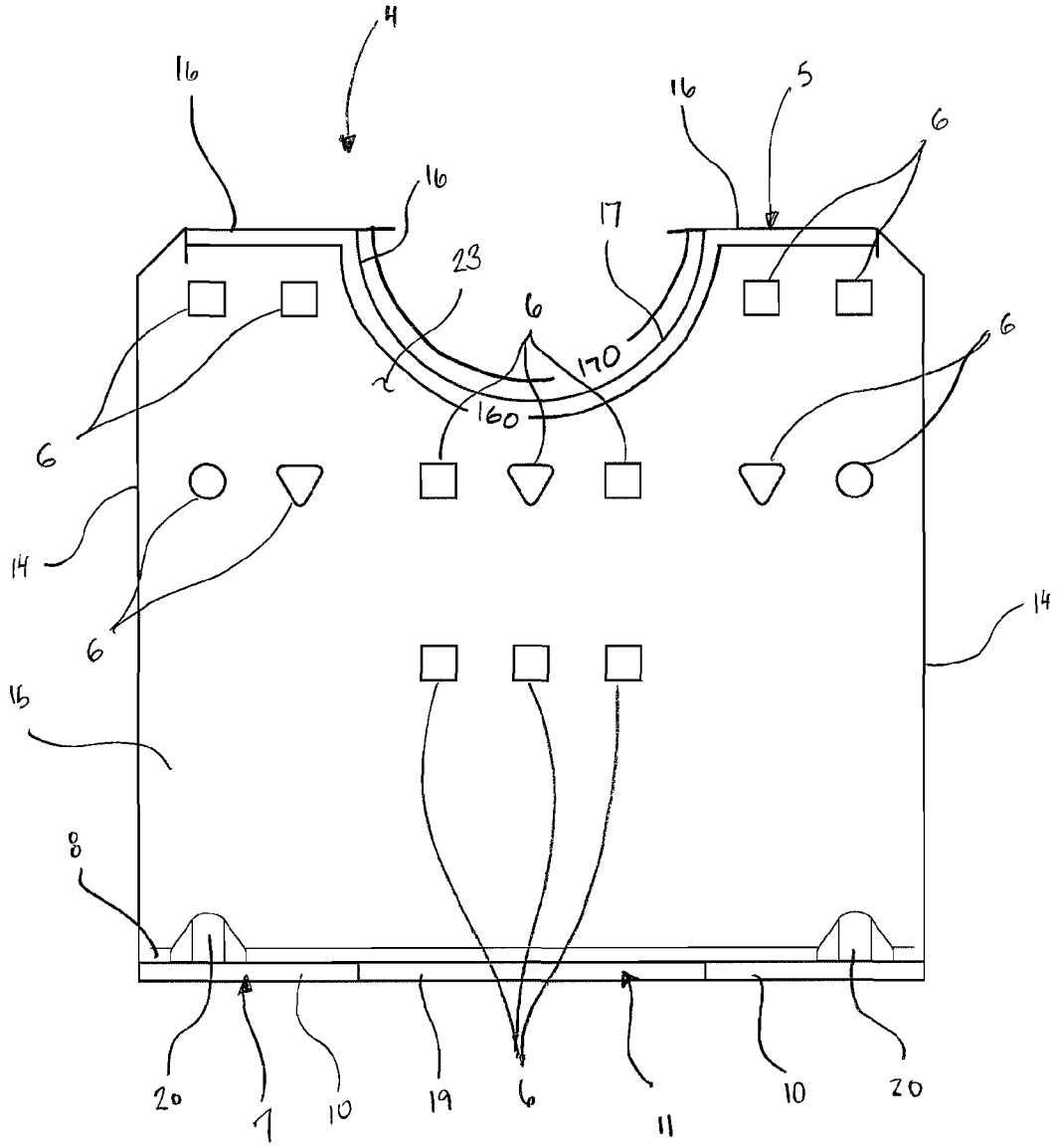
FIG. 3 is a front elevation view of the multipurpose connector of the present invention.
Figure 4:
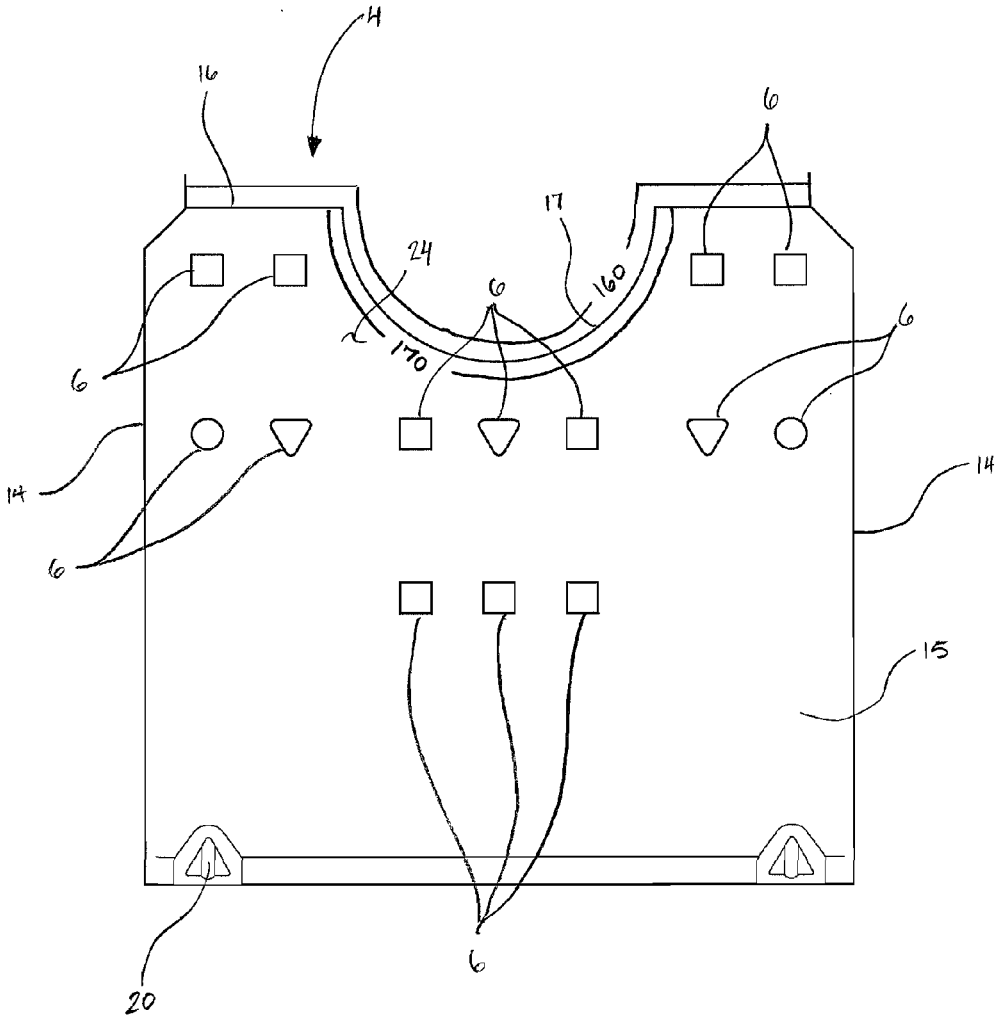
FIG. 4 is a rear elevation view of the multipurpose connector of the present invention.

As best seen in FIGS. 1 and 2, preferably the first flange 5 has a first body portion 15 bounded at least in part by a first outer boundary 16 at least partially opposite the first angular juncture 8. As seen in FIGS. 3 and 4, the first outer boundary 16 preferably has a first outer boundary length 160. Preferably, the first flange 5 has a first recess edge 17 that indents from the first outer boundary 16 toward the angular juncture 8. The first recess edge 17 preferably constricts the first body portion 15 of the first flange 5 along the first outer boundary 16. As seen in FIGS. 3 and 4, preferably the first recess edge 17 has a first recess edge length 170 that is less than the first outer boundary length 160. In the preferred embodiments, the first outer boundary 16 is parallel to the first angular juncture 8 in either side of the first recess edge 17. The first flange 5 preferably also has first and second sides 14 that connect the first outer boundary 16 of the first flange 5 to the first angular juncture 8. The first flange 5 preferably has a first inner surface 23 and a first outer surface 24. The first outer surface 24 interfaces with the first structural member 2. The first angular juncture 8 preferably is 90 degrees between the first inner surface 23 of the first flange 5 and the second inner surface 25 of the second flange 7.

In the most preferred embodiment, the first and second sides 14 of the first flange 5 are 4.25 inches apart, substantially straight, 4 inches long, and substantially parallel to each other. The four outermost (closest to the first and second sides 14) of the fastener openings 6 in the first flange 5 are centered 0.375 inches from the first and second sides 14, respectively, of the first flange 5. The four fastener openings 6 in the first flange nearest those are centered 0.875 inches from the first and second sides 14, respectively, of the first flange 5. The fastener openings 6 in the first flange 5 that are furthest from the first angular juncture 8 are centered 0.375 inches from the first outer boundary 16. The fastener openings 6 in the first flange 5 that are the next closest to the first outer boundary 16 are centered 1.375 inches from the first outer boundary 16. And the fastener openings 6 in the first flange 5 that are closest to the first angular juncture 8 are centered 2.375 inches from the first outer boundary 16.

As seen in FIGS. 8-10, at least one of the plurality of fasteners 18 preferably passes through one of the first plurality of fastener openings 6 in the first flange 5 and into the first structural member 2. If, as is preferred, the first structural member 2 is made of cold-formed steel, the fasteners 18 pass through both the first flange 5 and the material of the first structural member 2. Preferably, at least one of the plurality of fasteners 18 passes through at least one of the first bolt opening 13 and the second plurality of fastener openings 6 in the second flange 7 into the second structural member 3.

The most preferred masonry bolt 18 is the Simpson Strong-Tie Titen HD® anchor 18, a patented, high-strength screw anchor for concrete and masonry. It is designed for optimum performance in both cracked and uncracked concrete, a requirement that the 2009 International Building Code places on post-installed anchors. The high strength, easy to install Titen HD anchor 18 has been tested and shown to provide outstanding performance in cracked and uncracked concrete under both static and seismic loading conditions. The self-undercutting, non-expansion characteristics of the Titen HD anchor 18 make it ideal for structural applications, even at reduced edge distances and spacings. The Titen HD anchor 18 is recommended for permanent dry, interior non-corrosive environments or temporary outdoor applications.

As best seen in FIGS. 3-6, the connector 4 is preferably formed with fastener openings 6 of different shapes in both the first flange 5 and the second flange 7. Round fastener openings 6 can be specified for lower required loads, and triangular fastener openings 6 can additionally be specified for higher required loads. Square fastener openings 6 can be specified as optional or can be used alone, or in combination with round and triangular fastener openings 6 for alternate connections 1 and custom designs.

As seen in FIG. 8, the connector 4 is particularly suited to making a connection 1 between a cold-formed steel vertical stud 2 and a concrete floor or foundation 3. FIG. 8 specifically shows a moment-resisting kneewall application in which the connector 4 is used in conjunction with a Simpson Strong-Tie BP1/2-3 bearing plate 21 which reinforces the connection made to the foundation 3 with a masonry bolt 18.

As seen in FIG. 9, the connector 4 is also particularly suited to making top-of-wall connections 1 between headers 2 or beams 2 resting on masonry walls 3.

As seen in FIG. 10, the connector 4 can also be used to make a bridging member 2 to wall stud 3 connection 1. As shown, the innermost fastener openings 6 in the first flange 5 are sufficiently closely-spaced to be fastened to a standard u-channel bridging member 2, while the outermost fastener openings 6 in the second flange 7 are sufficiently far apart to be fastened on either side of a cold-formed steel stud knock-out opening 27.

The connector 4 of the present invention is designed to be a versatile all-purpose connector 4 in addition to its specific suitabilities and it can be used in non-load-bearing and load-bearing wall, floor and roof framing.

As seen in FIGS. 5 and 6, preferably the first tab 11 of the second flange 7 has an outer tab boundary 19 that is an open edge oriented away from the inner tab boundary 12 and the first angular juncture 8. The outer tab boundary 19 preferably has an outer tab boundary length 190 that is substantially equal to the first recess edge length 170.

As best seen in FIGS. 1 and 2, preferably the first bolt opening 13 is entirely within the first tab 11 of the second flange 7. The first tab 11 preferably is formed from the minimum amount of material needed to accommodate the first bolt opening 13.

Figure 7:
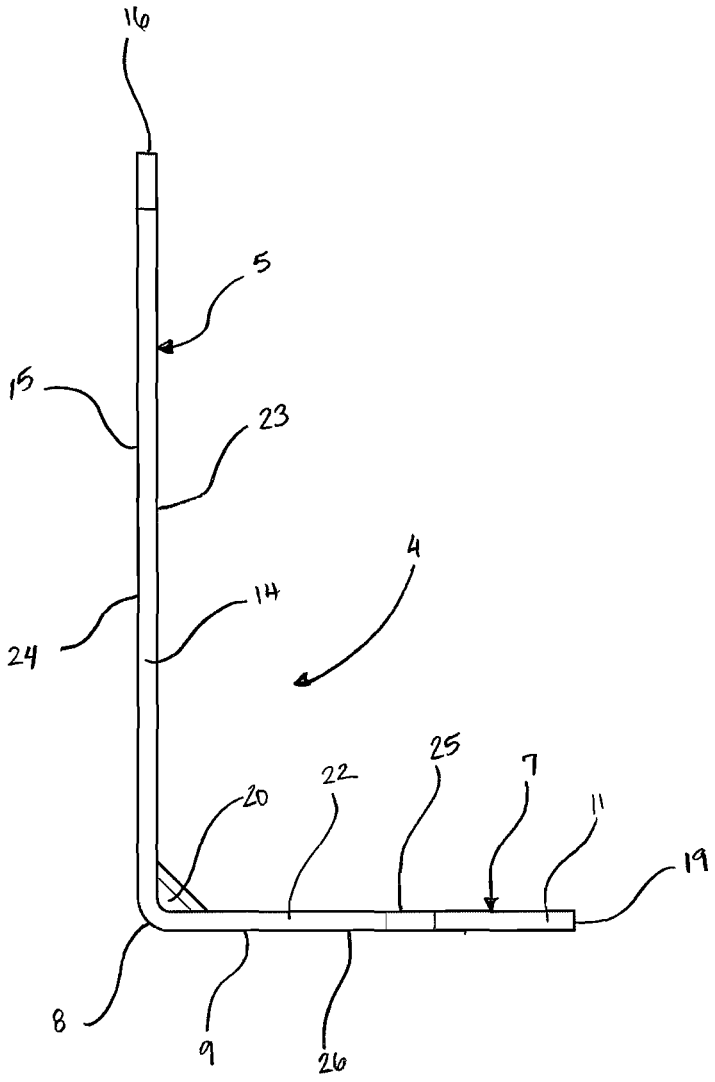
FIG. 7 is a left side elevation view of the multipurpose connector of the present invention.

As best seen in FIG. 7, preferably the first flange 5 extends further away from the first angular juncture 8 than the second flange 7 extends away from the first angular juncture 8. This particularly useful when the connector 4 is used as a holdown connector 4, which requires only a single bolt 18 in the second flange 7 but a plurality of fasteners in the first flange 5.

As best seen in FIGS. 8 and 9, the second structural member 3 can be a masonry structural member 3, which can be poured concrete or masonry units such as concrete block, brick, or the like. Preferably, at least one of the plurality of fasteners 18 is a masonry bolt 18, and the second flange 7 is fastened to the second structural member 3 with a masonry bolt 18.

As best seen in FIGS. 1 and 2, the outer tab boundary 19 preferably is a convex substantially semicircular arc 19, which largely matches the contour of the first bolt opening 13 in the first tab 11. Preferably, the first recess 17 is a concave substantially semicircular arc 17.

As best seen in FIGS. 3-6, the fastener openings 6 in the first flange 5 and the second flange 7 preferably are formed with different shapes that act as indicia for forming a variety of connections 1.

I claim:

1. A building connection (1) between a first structural member (2) and a second structural member (3), the first structural member (2) and the second structural member (3) being connected by a multipurpose connector (4) in conjunction with a plurality of fasteners (18), the building connection comprising:

a. the first structural member (2);

b. the second structural member (3);

c. the plurality of fasteners (18); and d. the multipurpose connector (4) comprising:

i. a first flange (5), at least a portion of which is substantially planar, with a first plurality of fastener openings (6);

ii. a second flange (7), at least a portion of which is substantially planar, with a second plurality of fastener openings (6), the second flange (7) being angularly joined to the first flange (5) at a first angular juncture (8) having a first juncture length (80), wherein:

(a) the second flange (7) has a second body portion (9) bounded at least in part by a second outer boundary (10) at least partially opposite the first angular juncture (8), the second outer boundary (10) having a second outer boundary length (100);

(b) the second flange (7) has a first tab (11) that extends from the second outer boundary (10) away from the angular juncture (8), the first tab (11) joining the second body portion (9) of the second flange (7) at an inner tab boundary (12) that is partially coincident with the second outer boundary (10), the inner tab boundary (12) having a inner tab boundary length (120) that is less than the second outer boundary length (100), and the first tab (11) of the second flange (7) has an outer tab boundary (19) that is an open edge oriented away from the inner tab boundary (12) and the first angular juncture (8), and the outer tab boundary (19) is a convex substantially semicircular arc (19);

(c) the second flange (7) has a first bolt opening (13) that is at least partially within the first tab (11) and is larger than at least one of the second plurality of fastener openings (6);

(d) the first flange (5) has a first body portion (15) bounded at least in part by a first outer boundary (16) at least partially opposite the first angular juncture (8), the first outer boundary (16) having a first outer boundary length (160);

(e) the first flange (5) has a first recess edge (17) that is part of the first outer boundary (16) and creates an indent in the first outer boundary (16) toward the angular juncture (8), the first recess edge (17) constricting the first body portion (15) of the first flange (5) along the first outer boundary (16), the first recess edge (17) having a first recess edge length (170) that is less than the first outer boundary length (160), the first recess (17) is a concave substantially semicircular arc (17) equal in contour to the semicircular arc of the outer tab boundary, and the outer tab boundary (19) has an outer tab boundary length (190) that is equal to the first recess edge length (170);

(f) at least one of the plurality of fasteners (18) passes through one of the first plurality of fastener openings (6) in the first flange (5) and into the first structural member (2); and (g) at least one of the plurality of fasteners (18) passes through at least one of the first bolt opening (13) and the second plurality of fastener openings (6) in the second flange (7) into the second structural member (3).

2. The building connection (1) of claim 1 wherein:

a. the first bolt opening (13) is entirely within the first tab (11) of the second flange (7).

3. The building connection (1) of claim 2 wherein:

a. the first flange (5) extends further away from the first angular juncture (8) than the second flange (7) extends away from the first angular juncture (8).

4. The building connection (1) of claim 1 wherein:

a. the second structural member (3) is a masonry structural member (3);

b. at least one of the plurality of fasteners (18) is a masonry bolt (18); and c. the second flange (7) is fastened to the second structural member (3) with a masonry bolt (18).

5. The building connection (1) of claim 4 wherein:

a. the masonry structural member (3) is formed from concrete.

6. The building connection (1) of claim 1 wherein:

a. the fastener openings (6) in the first flange (5) and the second flange (7) are formed with different shapes that act as indicia for forming a variety of connections (1).

7. The building connection (1) of claim 1 wherein:

a. the first structural member (2) is a substantially horizontal bridging member (2) stabilizing a substantially vertical wall stud (3).

* * * * *